US005138539A

United States Patent [19]

Honda et al.

[11] Patent Number: 5,138,539

[45] Date of Patent: Aug. 11, 1992

[54] FLUORESCENT LAMP DEVICE

[75] Inventors: Hisashi Honda; Katsuhide Misono, both of Yokohama, Japan

[73] Assignee: Toshiba Lighting & Technology Corporation, Tokyo, Japan

[21] Appl. No.: 627,849

[22] Filed: Dec. 14, 1990

[30] Foreign Application Priority Data

Dec. 18, 1989 [JP] Japan ..... 1-325863
Dec. 23, 1989 [JP] Japan ..... 1-333599

[51] Int. Cl.[5] ..... F21K 2/00

[52] U.S. Cl. ..... 362/221; 362/260; 362/265; 362/84; 439/226; 439/239

[58] Field of Search ..... 362/221, 222, 223, 224, 362/260, 263, 265, 84; 439/226, 239, 242, 741

[56] References Cited

U.S. PATENT DOCUMENTS

| | | | |
|---|---|---|---|
| 2,668,279 | 2/1954 | Epstein | 439/741 |
| 3,508,103 | 4/1970 | Young | 362/260 |
| 4,089,045 | 5/1978 | Mars | 362/84 |
| 4,494,326 | 1/1985 | Kanamori | 362/84 |
| 4,561,044 | 12/1985 | Ogura et al. | 362/84 |
| 4,864,473 | 9/1989 | Tokarz et al. | 362/84 |

*Primary Examiner*—Ira S. Lazarus
*Assistant Examiner*—Y. Quach
*Attorney, Agent, or Firm*—Oblon, Spivak, McClelland, Maier & Neustadt

[57] ABSTRACT

A fluorescent lamp device comprises an oblate section type fluorescent lamp having an oblate cross section and provided with a luminous surface illuminating in one direction and with a back plate and a lighting circuit means attached to the back plate and adapted to light the fluorescent lamp. The fluorescent lamp is electrically connected to and integrally assembled with the lighting means including the lighting circuit board by the bendable leads and the terminal pieces capable of having various shapes. In addition, a fluorescent lamp device comprises a fluorescent lamp body which includes a front plate, a back plate and a spacer which is provided between the front plate and the back plate and which defines the oblate sectioned bulb of the fluorescent lamp. The bulb airtightly containing at least a pair of cold cathodes and rare gases, the flourescent lamp device being so designed that the discharge current density, which is the ratio of the discharge current between the pair of cold cathodes to the area of the oblate section of the bulb, is 0.30 mA/mm$^2$ or less and that the flatness F, which is the ratio of the length in the longitudinal direction of the oblate section of the bulb to the length in the lateral direction of the same, and the pressure P (torr) of the rare gases satisfy at least one of the following inequalities (1) and (2):

When $1 \leqq F \leqq 3$, $3 \leqq P \leqq 200$ (1)

When $3 \leqq F \leqq 8$, $3 \leqq P \leqq e(-0.37\,F+6.4)$ (2).

12 Claims, 14 Drawing Sheets

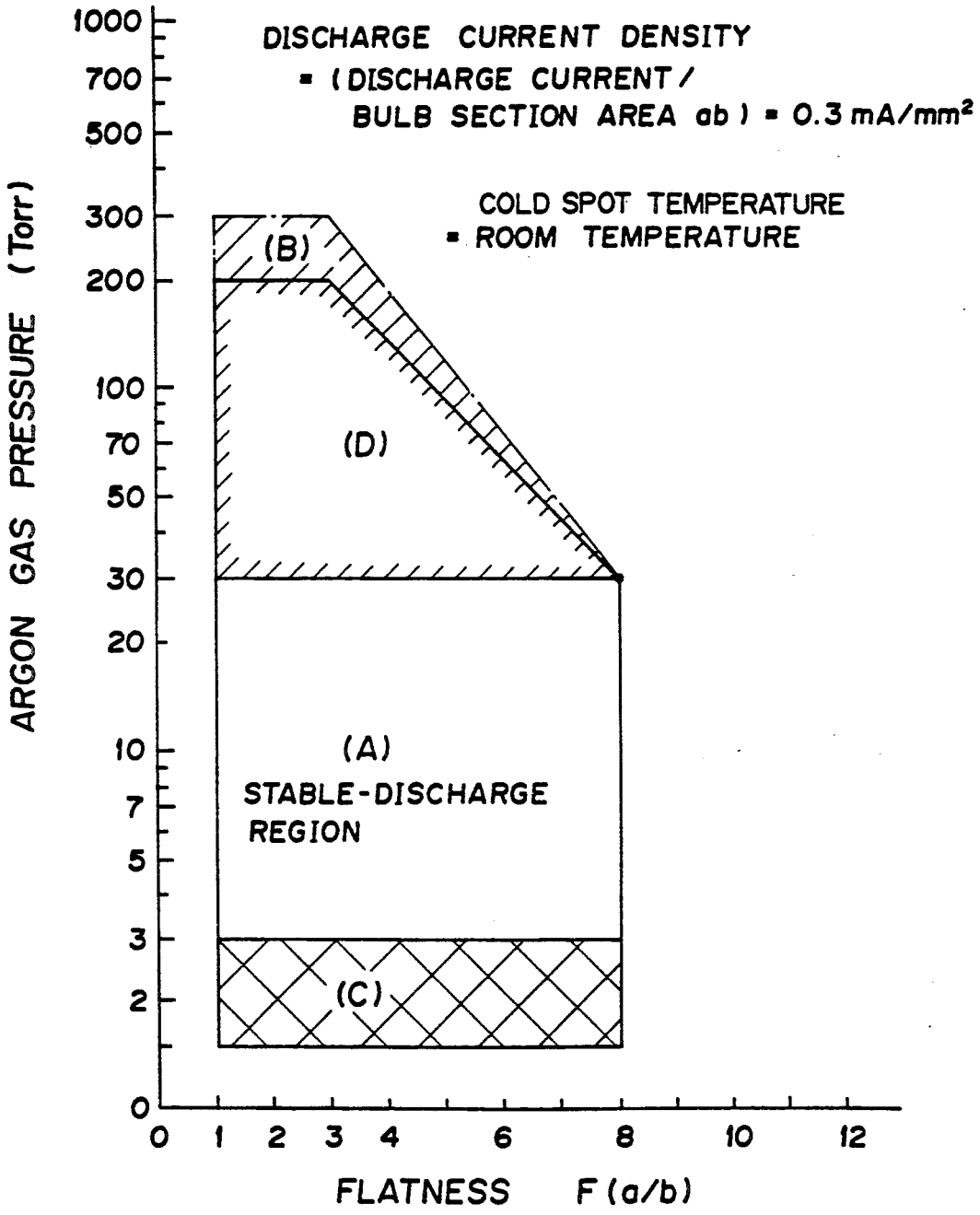
FIG. 21
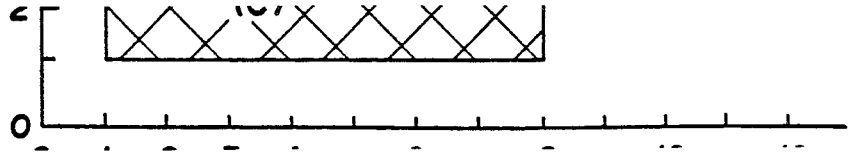

FLUORESCENT LAMP DEVICE

BACKGROUND OF THE INVENTION

This invention relates to a fluorescent lamp device particularly of an oblate section type in which the lighting means is integrally mounted on a fluorescent lamp having an oblate cross section and, in particular, to a fluorescent lamp device which reduces the thickness of the fluorescent lamp and improves the efficiency of the lamp.

A known art has provided a flat-type fluorescent lamp device of the type in which the flat-type fluorescent lamp is electrically connected to a lighting circuit thereof and fixed to the mounting board is disclosed, for example, in Japanese Utility Model Laid-Open Publication No. 58-130352.

In the above-mentioned example, the fluorescent lamp has a luminous surface with a substantially U-shaped plan-view configuration, and an exhaust tube, which is provided at one end of the lamp, is covered with a protective cap and fitted into a substantially U-shaped holder, which is provided on the mounting board, thus securely positioning the lamp on the mounting board.

While one end of the fluorescent lamp is thus being held in position, electrode leads thereof, which extend horizontally outwards from the other end of the lamp, are respectively inserted into the fitting holes of a lampholder, which is attached to the mounting board, thereby fixing the other end of the fluorescent lamp to the mounting board and electrically connecting it to the associated lighting circuit through the lampholder.

The conventional fluorescent lamp device of the described type involves a problem such that the attaching of the lighting circuit has to be effected separately from that of the fluorescent lamp. Accordingly, when the fluorescent lamp device is incorporated into the display panel of a liquid crystal television set, for example, or the like as a backlighting, attaching members for separately attaching the fluorescent lamp and the lighting circuit have to be provided, with the number of attaching steps being inevitably large.

Furthermore, since the fluorescent lamp and the lighting circuit are not integrally attached to each other, the size of the entire device is rather large.

Generally speaking, it is required that such a fluorescent lamp be as thin as possible and, at the same time, it has to provide high and uniform liminance. Japanese Patent Laid-Open No. 62-208537 discloses a fluorescent lamp having an oblate cross section, which is an example of a fluorescent lamps which meets the above requirements.

However, as a result of the excessive reducing of the bulb thickness of a fluorescent lamp, the following problem has occurred. Namely, when the bulb flatness, which is the ratio of the length in the longitudinal direction of the flat bulb section (hereinafter referred to as the longer diameter) to the length in the lateral direction of the same (hereinafter referred to as the shorter diameter), exceeds a certain value, undesirable phenomena, such as the so-called discharge concentration and positive column swinging, are caused, thereby making it impossible to stabilize the lighting condition.

It is known, that, apart from the bulb flatness mentioned above, the discharge stability of a fluorescent lamp of this type depends upon the pressure of the filling gas, which consists of rare gases, in particular, argon, and the discharge current density, which is a value obtained by dividing the discharge current between the pair of cold cathodes of a bulb by the area of the bulb section.

However, conditions for stabilizing the above discharge and thus obtaining a highly efficient fluorescent lamp which can be used in a practical manner still remain unknown.

Accordingly, no conventional fluorescent lamps of this type have been able to simultaneously meet the two requirements of substantially reducing the bulb thickness and improving the efficiency of the lamp.

SUMMARY OF THE INVENTION

An object of the present invention is to substantially elliminate defects or drawbacks encountered in the prior art described above and to provide a fluorescent lamp device of a substantially reduced size.

Another object of the present invention is to provide a fluorescent lamp device which has a substantially reduced bulb thickness and which is more efficient.

These and other objects of the present invention can be achieved in one aspect by providing a fluorescent lamp device comprising an oblate section type fluorescent lamp having an oblate cross section and provided with a luminous surface illuminating in one direction and a back plate opposing to the luminous surface and a lighting means attached to the back plate and adapted to light the oblate section type fluorescent lamp.

In another aspect of the present invention, there is provided a fluorescent lamp device comprising an oblate section type fluorescent lamp having an oblate cross section, a lighting circuit means mounted on said oblate section type fluorescent lamp and an attaching means for attaching the lighting circuit means to the oblate section type fluorescent lamp, the attaching means being led from the fluorescent lamp and consisting of a pair of bendable leads which are respectively electrically connected to a pair of electrodes, one end of each of the leads being engaged with electric terminal pieces of the lighting circuit means in such a manner as to be electrically connected to and engaged with the lighting circuit means. The oblate section type fluorescent lamp includes a fluorescent lamp body consisting of a front plate, the back plate and a spacer which is provided between the front plate and the back plate and which defines the bulb of the oblate section type fluorescent lamp, the lighting circuit means being composed of a board which is to be placed on the back plate to said fluorescent lamp body and a lighting circuit which is attached to the board.

In a further aspect of the present invention, there is provided a flat-type fluorescent lamp device comprising a fluorescent lamp body which defines an oblate sectioned bulb of fluorescent lamp, the bulb airtightly containing at least a pair of cold cathodes and rare gases, the fluorescent lamp device being so designed that the discharge current density, which is the ratio of the discharge current between the pair of cold cathodes to the area of the oblate section of the bulb, is 0.30 $mA/mm^2$ or less and that the flatness F, which is the ratio of the length in the longitudinal direction of the oblate section of the bulb to the length in the lateral direction of the same, and the pressure P (torr) of the rare gases satisfy at least one of the following inequalities (1) and (2):

When $1 \geqq F \geqq 3$, $3 \geqq P \geqq 200$ (1)

When $3 \geqq F \geqq 8$, $3 \geqq P \geqq e(-0.37F+6.4)$ (2)

In a still further aspect of the present invention, there is provided a flat-type fluorescent lamp device comprising an oblate section type fluorescent lamp having an oblate cross section, a lighting circuit means mounted on the oblate section type fluorescent lamp and an an attaching means for attaching the lighting circuit means to the fluorescent lamp, the fluorescent lamp including a fluorescent lamp body which consists of a front plate, a back plate and a spacer which is provided between the front plate and the back plate and which defines the bulb of the oblate section type fluorescent lamp, the lighting circuit means being composed of a board which is to be placed on the back plate of the fluorescent lamp body and a lighting circuit which is attached to the board, the attaching means consisting of a pair of bendable leads which are respectively electrically connected to a pair of electrodes, one end of each of the leads extending outwards from inside the fluorescent lamp body and being engaged with the board in such a manner as to be electrically connected to and lock the board, the bulb airtightly containing at least a pair of cold cathodes and rare gases, the fluorescent lamp device being so designed that the discharge current density, which is the ratio of the discharge current between the pair of cold cathodes to the area of the oblate section of the bulb, is 0.30 $mA/mm^2$ or less and that the flatness F, which is the ratio of the length in the longitudinal direction of the oblate section of the bulb to the length in the lateral direction of the same, and the pressure P (torr) of the rare gases satisfy at least one of the following inequalities (1) and (2):

When $1 \geqq F \geqq 3$, $3 \geqq P \geqq 200$ (1)

When $3 \geqq F \geqq 8$, $3 \geqq P \geqq e(-0.37F+6.4)$ (2)

In preferred embodiments, the attaching member is composed of the bendable leads capable of having various shapes and terminal pieces having shapes corresponding to those of the bendable leads as clearly recited in the dependent claims attached hereto.

According to the fluorescent lamp device of the structures and the characters of the present invention, the lighting means is mounted to the back plate, so that the lamp devive is constructed in compact structure and the electrical connection of the bendable leads and the electric terminal pieces of the lighting circuit board is electrically contacted and simultaneously both are integrally assembled, thus eliminating the working steps.

In another aspect, the discharge current density, the flatness F and the rare gas pressure are set to the stable discharging area in which the thickness of the bulb and the lamp efficiency can be improved.

Many advantageous functions and effects may be attained by the various possible combinations according to the present invention.

BRIEF DESCRIPTION OF THE DRAWINGS

For a better understanding of the present invention and to show how the same is carried out, reference is made, by way of preferred embodiments, to the accompanying drawings, in which:

FIGS. 9 to 13 show the construction of a flat-type fluorescent lamp device in accordance with a fifth embodiment of this invention, in which:

FIG. 9 is an exploded perspective view of the same embodiment;

FIG. 10 is a perspective view showing the device being assembled;

FIG. 11 is a plan view corresponding to FIG. 10;

FIG. 12 is a plan view showing the device completely assembled;

FIG. 13 is a perspective view showing the essential part of a modification to the embodiment shown in FIG. 12;

FIGS. 14 to 19 show the construction of a sixth embodiment of this invention, in which:

FIG. 14 is a partially exploded perspective view of the same embodiment;

FIG. 15 is a perspective view of the same embodiment completely assembled;

FIG. 17 is a longitudinal sectional view of the same embodiment incorporated into a light-source lodging section;

FIG. 18 is an enlarged view of the section XVII of FIG. 17;

FIG. 19 is a front view showing the way in which the fluorescent lamp of this embodiment is incorporated into the light-source lodging section;

FIG. 21 is a graph showing the flatness and the set rare-gas filling pressure range of an oblate section type fluorescent lamp in accordance with this invention;

DESCRIPTION OF THE PREFERRED EMBODIMENTS

Figure 24:
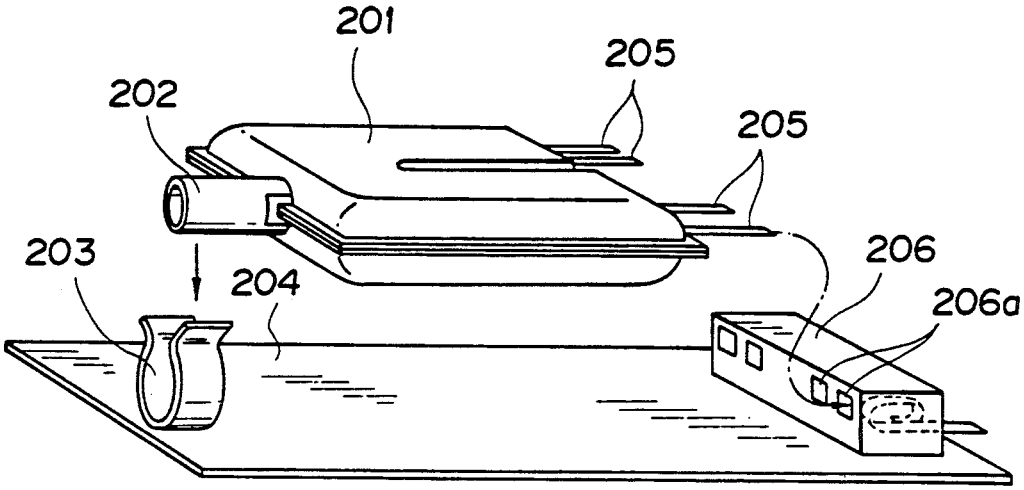
FIG. 24 PRIOR ART
FIG. 24 is a partial perspective view of a conventional flat-type fluorescent lamp device.

In order to facilitate the understanding of the present invention, a conventional flat-type fluorescent lamp will be briefly described with reference to FIG. 24.

The fluorescent lamp 201 shown has a luminous surface with a substantially U-shaped plan-view configuration, and an exhaust tube thereof, which is provided at one end of the lamp (the left-hand side end in the drawing), is covered with a protective cap 202 and fitted into a substantially U-shaped holder 203, which is provided on the mounting board 204, thus securely positioning the lamp on the mounting board 204.

While one end of the fluorescent lamp 201 is thus being held in position, electrode leads 205, 205, which extend horizontally outwards from the other end of the lamp, are respectively inserted into the fitting holes 206*a* of a lampholder 206, which is attached to the mounting board 204, thereby attaching the other end of the fluorescent lamp 201 to the mounting board 204 and electrically connecting it to the associated lighting circuit, not shown, through this lampholder 206.

Such a conventional fluorescent lamp, however, has the problems mentioned hereinbefore.

Embodiments of the present invention will now be described with reference to FIGS. 1 to 19, in which the components that are common to the embodiments described below will be referred to by the same reference numerals.

Figure 1A:
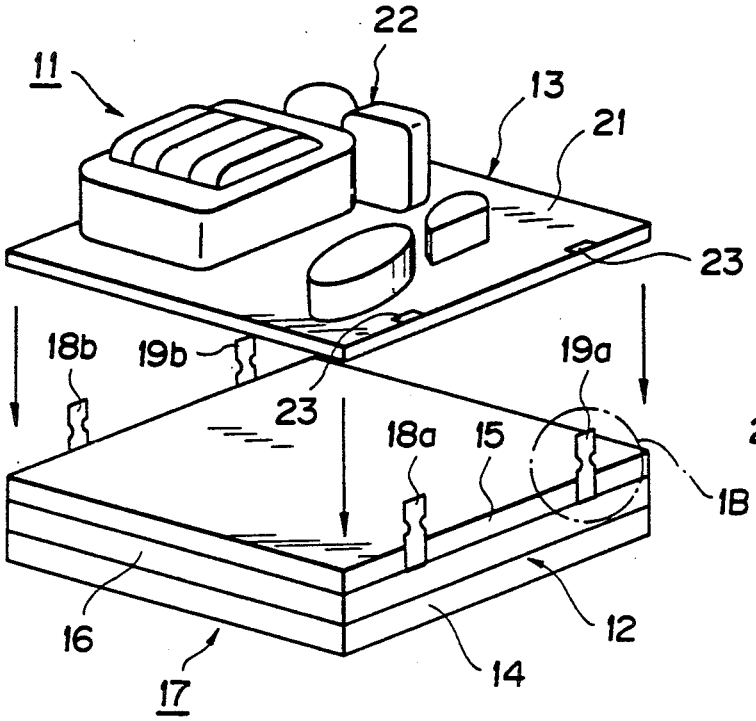
FIG. 1A is an exploded perspective view of a fluorescent lamp device in accordance with a first embodiment of this invention.

FIG. 1A is an exploded perspective view of an oblate section type fluorescent lamp device in accordance with a first embodiment of this invention. It is first to be noted that the following embodiments may be positively applied to a flat type fluorescent lamp device. The oblate section type fluorescent lamp device 11 shown comprises a fluorescent lamp 12 having an oblate cross section and a lighting circuit board 13, which constitutes the lighting means and which is fixed to the non-luminous surface of the fluorescent lamp 12.

The oblate section type fluorescent lamp 12 is composed of a front plate 14, a back plate 15 facing the front plate 14, and a spacer 16 placed between these two plates. The front plate 14 constitutes the luminous surface and consists of a transparent plate glass whose inner surface is coated with a fluorescent film. The back plate 15 has no luminous surface and consists of a plate glass with the same size and configuration as those of the front plate 14. The spacer 16 is in the form of a rectangular frame, which is airtightly placed between the respective outer peripheral edge sections of these plates 14, 15, thus forming the lamp body 17 as a sealed container.

A predetermined amount of mercury and rare filling gases including argon, are sealed in the lamp body 17.

Figure 9:
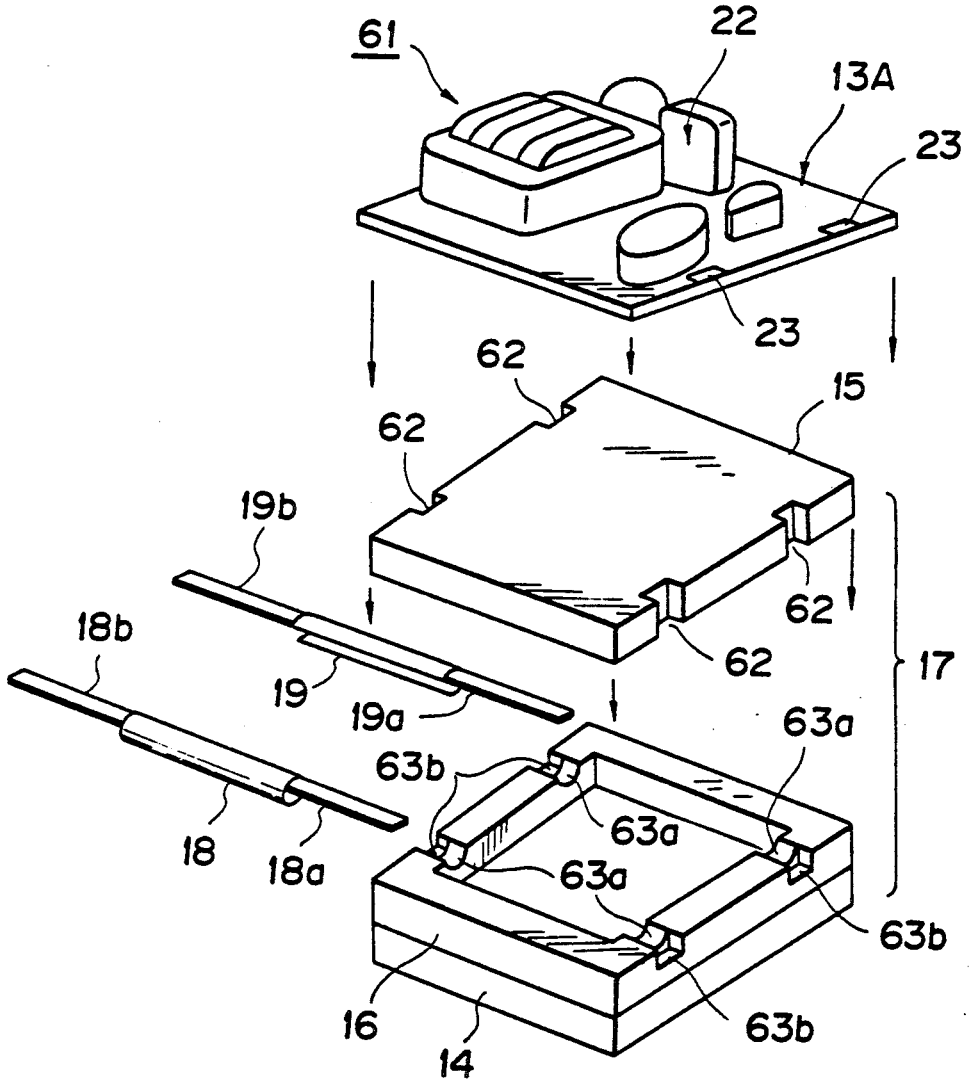

The lamp body 17 further contains a pair of electrodes, (for example, as shown in FIG. 9 as numerals 18 and 19), which consist, for example, of hollow-cathode-type cold electrodes and which are oppositely arranged and spaced from each other. Electrically connected to both ends in the axial direction of these electrodes are electrode leads 18*a*, 18*b*, 19*a* and 19*b*, which are in the form of strips.

These electrode leads 18*a*, 18*b*, 19*a* and 19*b* extend airtightly outwards, passing, for example, between the mating faces of the back plate 15 and the spacer 16. These electrode leads are bent substantially at right angles toward the outer peripheral surfaces of the back plate 15 so as to extend upwards (as seen in the drawing) along these outer peripheral surfaces.

Figure 1B:
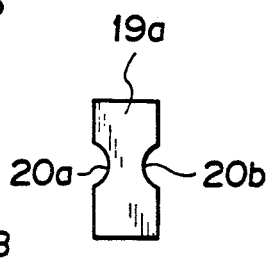
FIG. 1B is an enlarged front view of the section IB of FIG. 1A.

As shown in FIGS. 1A and 1B, each of the electrode leads 18*a*, 18*b*, 19*a* and 19*b* is provided with a pair of arc-like side cutouts, 20*a*, 20*b*. These cutouts, which are to be brought to a position somewhat higher than the upper surface of the back plate 15 as seen in the drawing, allow the electrode leads to be bent with ease.

The lighting circuit board 13, which constitutes the lighting means, includes a board 21 having the same size and configuration as those of the back plate 15. Mounted on this board 21 is a lighting circuit 22 for lighting the oblate section type fluorescent lamp 12. Electric terminals 23 in the form of rectangular strips are embedded in the outer peripheral sections of the board 21 with their upper surfaces being exposed at positions corresponding to the electrode leads 18*a*, 18*b*, 19*a* and 19*b*. A microcomputer, not shown, may be incorporated into the lighting circuit 22.

Figure 2A:
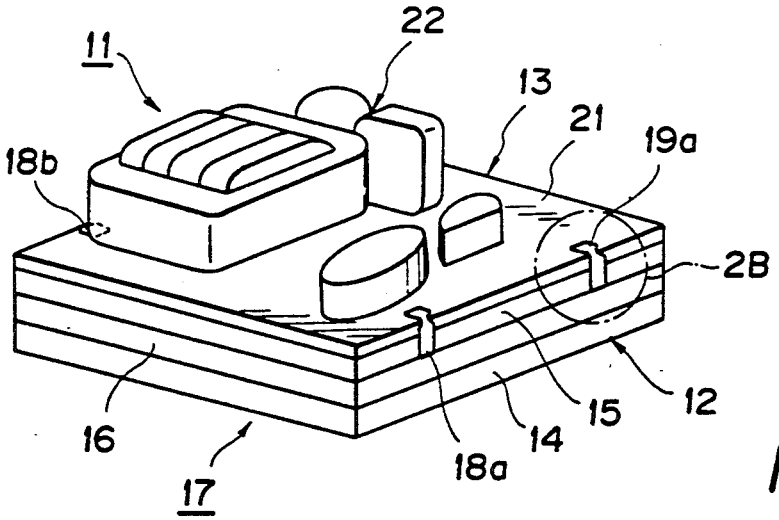
FIG. 2A is a perspective view showing the device of FIG. 1A completely mounted.
Figure 2B:
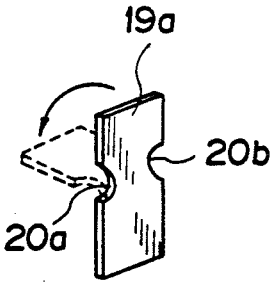
FIG. 2B is an enlarged perspective view of the section IIB of FIG. 2A.

The lighting circuit board 13 is placed on the back surface of the back plate 15 with no luminous surface, as shown in FIG. 1A, with the outer end sections of the electrode leads 18*a*, 18*b*, 19*a* and 19*b* being inwardly bent substantially at right angles, as shown in FIGS. 2A and 2B.

In this way, the lighting circuit board 13 is attached to the back surface of the back plate 15, and the bent end sections of the electrode leads 18*a*, 18*b*, 19*a* and 19*b* are electrically brought into contact with, i.e., connected to, the respective electric terminals 23.

Thus, in accordance with this embodiment, the lighting circuit board 13 is integrally attached to the fluorescent lamp 12, so that the size of the entire fluorescent lamp device 11 can be made smaller.

Furthermore, when the lighting board 13 is attached to the back surface of the oblate section type fluorescent lamp 12 by inwardly bending the electrode leads 18*a*, 18*b*, 19*a* and 19*b*, the electrical connection between the electrode leads 18*a*, 18*b*, 19*a* and 19*b* and the respective electric terminals 23 is effected simultaneously, which means the fluorescent lamp of this invention can be assembled with ease.

Figure 3:
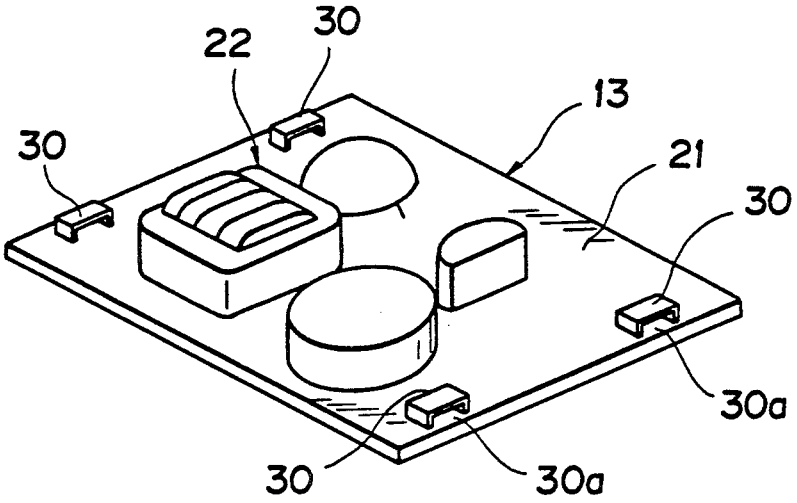
FIG. 3 is a perspective view showing the essential part of a fluorescent lamp device in accordance with a second embodiment of this invention.
Figure 4:
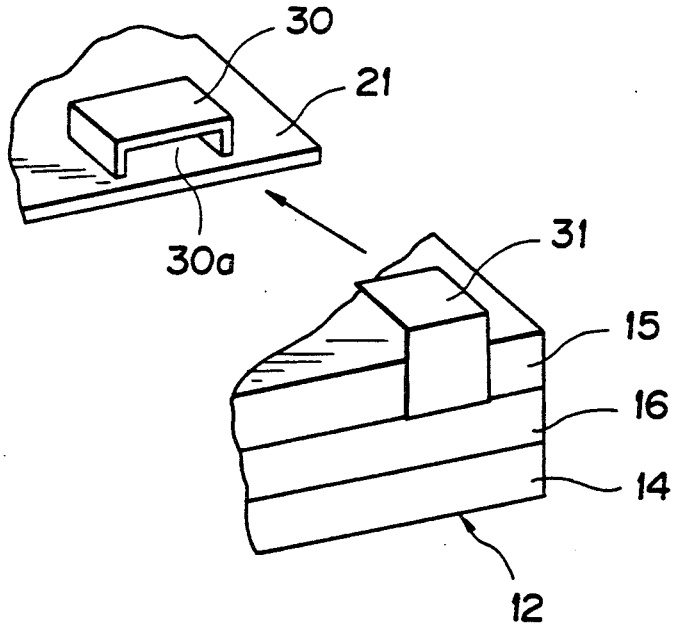
FIG. 4 is an enlarged partial perspective view showing the condition in which an electrode lead is about to be inserted into one of the electric terminals shown in FIG. 3.

FIGS. 3 and 4 show the construction of a second embodiment of this invention. In this embodiment, the flat electric terminals 23 shown in FIG. 1A are replaced by U-shaped electric terminals 30 as shown in FIGS. 3 and 4, and the electrode leads 18*a*, 18*b*, 19*a* and 19*b* are formed as strip-like electrode leads 31 which can be closely fitted into the side openings 30*a* of the U-shaped electric terminals 30, as shown in FIG. 4.

Apart from this, the construction of this embodiment is no different from that of the first embodiment, so that a description thereof will be omitted.

In accordance with this embodiment, the outer end sections of the electrode leads 31 are closely fitted into the respective side openings 30*a* of the U-shaped electric terminals 30, so that the oblate section type fluorescent lamp 12 is protected against any force which would displace it laterally with respect to the lighting circuit board 13 because both side edges of each electrode lead 31 are held by the side walls of the associated U-shaped electric terminal 30.

Figure 5:
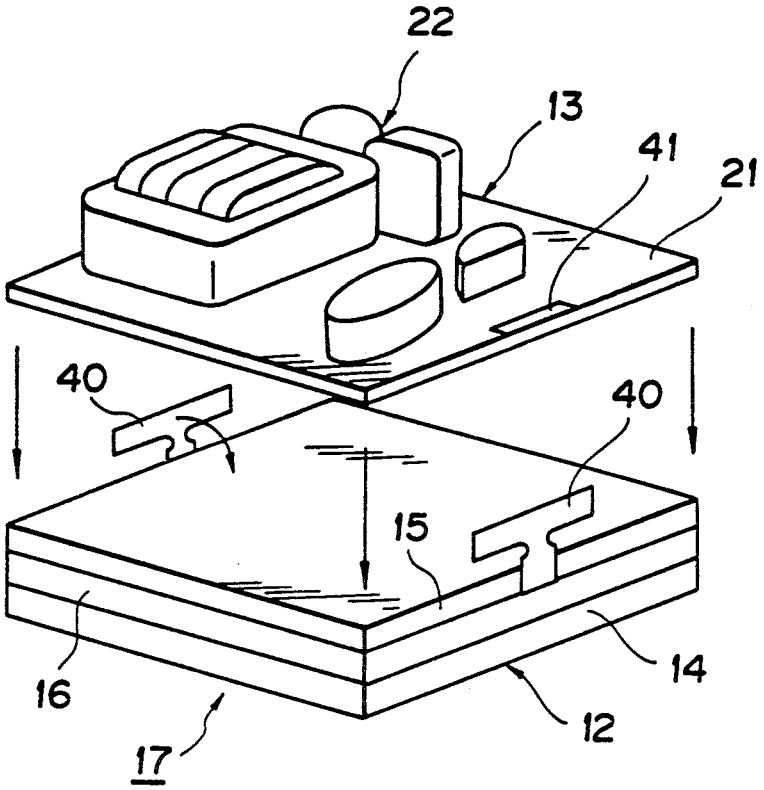
FIG. 5 is an exploded perspective view of a fluorescent lamp device in accordance with a third embodiment of this invention.
Figure 6:
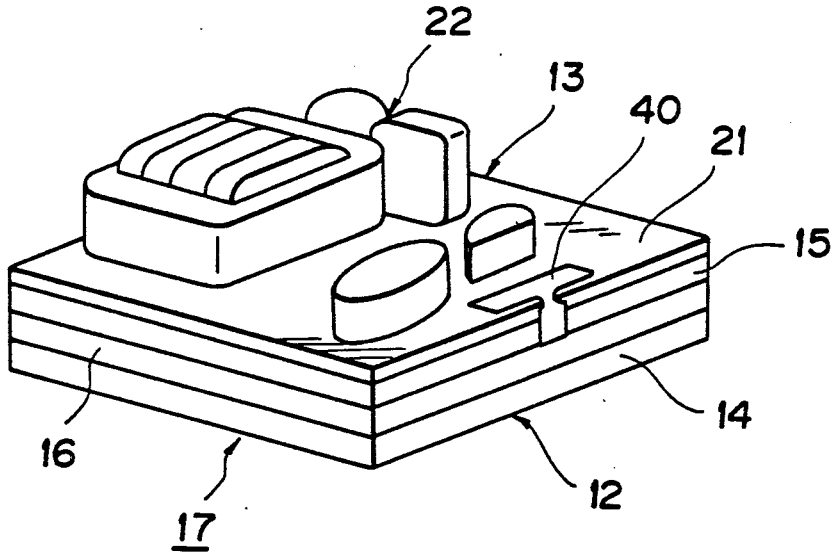
FIG. 6 is a perspective view showing the device of FIG. 5 completely mounted.

FIGS. 5 and 6 are overall perspective views of a fluorescent lamp device in accordance with a third embodiment of this invention. In this embodiment, the electrode leads 18*a*, 18*b*, 19*a* and 19*b* are replaced by a pair of T-shaped electrode leads 40, 40, and the electric terminals 23 are replaced by a pair of electric terminals 41, each being wider than that of the first embodiment. Apart from this arrangement, the construction of this third embodiment is not different from that of the first embodiment.

The pair of T-shaped electrode leads 40 consist of metal strips, the respective inner end sections of which are electrically connected to the respective middle sections in the axial direction of a pair of electrodes, not shown, provided in the lamp body 17.

The respective external end sections of the electrode leads 40 extend outwards in an airtight manner between the mating faces of the back plate 15 and the spacer 16, and are bent squarely so as to extend upwards along the outer peripheral surfaces of the back plate 15. The respective external end sections of these electrode leads have an approximately T-shaped configuration.

The wide electric terminals 41 consist of quadrangular metal plates, which are embedded in the outer peripheral sections of the upper surface of the board 21, with their upper surfaces exposed, at positions corresponding to the T-shaped end sections of the electrode leads 40.

When attaching the lighting circuit board 13 thus constructed integrally to the oblate section type fluorescent lamp 12, the lighting circuit board 13 is first placed on the back surface of the back plate. 15 of the fluorescent lamp 12, as shown in FIG. 5, and as shown in FIG. 6, the T-shaped end sections of the pair of electrode leads 40 are bent inwardly over the wide electric terminals 41, thereby attaching the lighting circuit board 13 on the oblate section type fluorescent lamp 12.

Thus, in accordance with this embodiment, both the electrical connection of the T-shaped leads 40, 40 to the lighting circuit 22 through the wide electric terminals 41, and the attachment of the lighting circuit board 13 to the fluorescent lamp 12, are effected solely by bending the two T-shaped electrode leads 40, 40, thus simplifying the assembling operation.

Further, since the electrode leads 40 are equipped with wide, T-shaped end sections, they can be held in contact with the lighting circuit board 13 with a wider contact area, which means they provide firmer supporting for the lighting circuit board 13.

Figure 7:
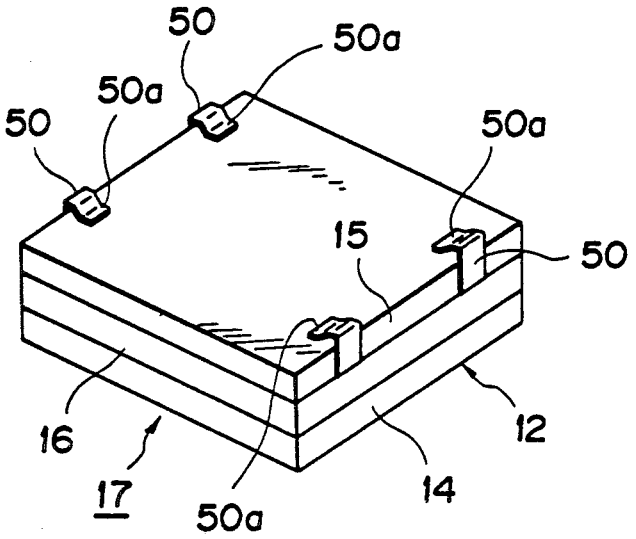
FIG. 7 is a perspective view showing the essential part of a fluorescent lamp device in accordance with a fourth embodiment of this invention.
Figure 8:
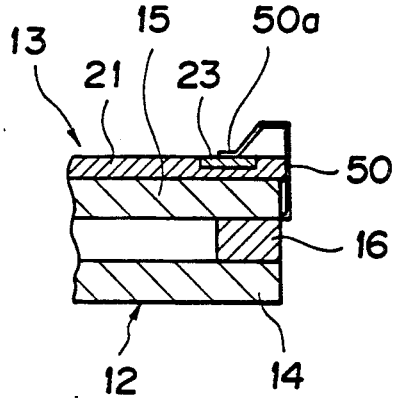
FIG. 8 is a longitudinal sectional view of the essential part of the device according to the fourth embodiment.

FIGS. 7 and 8 show a fourth embodiment of the this invention. In this embodiment, the four electrode leads 18*a*, 18*b*, 19*a* and 19*b* of the first embodiment are replaced by four electrode leads 50, 50, . . . , as shown in FIGS. 7 and 8.

These electrode leads 50 consist of resilient metal strips, whose respective inner ends are electrically connected to the respective ends in the axial direction of a pair of electrodes, not shown, provided in the lamp body 17.

The respective external end sections of the electrode leads 50 are, as shown in FIG. 8, bent at a position somewhat higher than the upper surface of the board 21 of the lighting circuit board 13, which is placed on the back surface of the back plate 15 of the lamp body 17, with the front ends 50*a* of the electrode leads 50 being resiliently pressed against the respective upper surfaces of the electric terminals 23. In this way, the board 21 is attached to the back plate 15 of the oblate section type fluorescent lamp 12.

Thus, this embodiment also allows the lighting circuit board 13 to be integrally and firmly attached to the fluorescent lamp 12.

FIGS. 9 to 13 show the construction of a fluorescent lamp device 61 in accordance with a fifth embodiment of this invention. This fluorescent lamp device 61, which has a construction that is substantially identical with that of the fluorescent lamp device 11 of the first embodiment, is characterized in that it is equipped with rectangular cutouts 62, which are formed, as shown in FIG. 9, in those portions of the side surfaces of the back plate 15 with no luminous surface which are to be brought into contact with the inner surfaces of the electrode leads 18*a*, 18*b*, 19*a* and 19*b*, which extend upwards as viewed in FIG. 9.

The width of each of the cutouts 62 is substantially equal to that of the lead 18*a* and the length thereof covers the entire thickness of the back plate 15.

Figure 10:
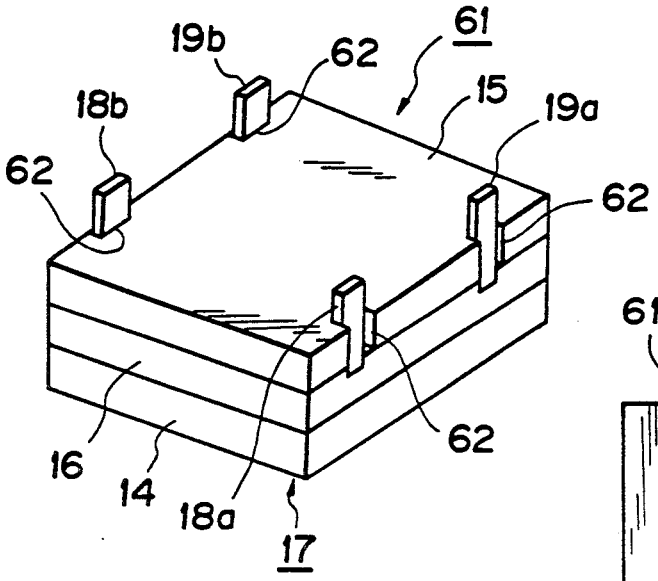
Figure 11:
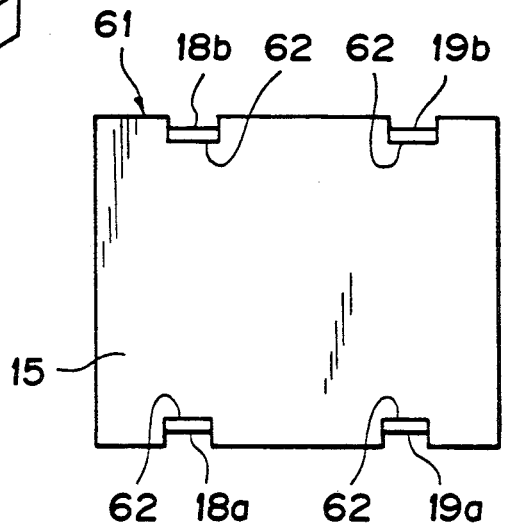

Moreover, the depth of each of the cutouts 62 is larger than the thickness of the lead 18*a* so that when the leads 18*a* are fitted into the respective cutouts 62 in such a manner as to cross the back plate 15, as shown in FIGS. 10 and 11, the outer surfaces of the leads 18*a* are in recessed positions with respect to the outer side surfaces of the back plate 15, thus preventing these leads from protruding outwards.

If the leads 18*a* were allowed to protrude beyond the side surfaces of the back plate 15, the size of the fluorescent lamp device 61 as measured from end to end would become so much the larger. In addition, dead spaces would exist around the protruding end sections. That is why the protrusion of the leads must be avoided.

As shown in FIG. 9, arc-like inner recesses 63*a* for allowing the leads 18*a* to extend outwards are formed in the inner section of the upper end surface, as viewed in FIG. 9, of the spacer 16. Further, formed in the outer section of the upper end surface of the spacer 16 are rectangular outer recesses 63*b*, which are somewhat deeper than the inner recesses 63*a*. Each of these outer recesses 63*b* is situated adjacent to the associated inner recess 63*a*.

Thus, by filling these inner and outer recesses 63*a* and 63*b* with, for example, frit glass, with the leads 18*a* horizontally extending outwards through them, the inserting sections for these leads 18*a* can be airtightly sealed.

After the above sealing has been completed, the protruding end sections of the leads 18*a* are bent at their root at approximately right angles toward the back plate 15, so that they extend upwards substantially in the vertical direction.

Accordingly, the leads 18*a* extend upwards while they are being fittingly held in the recesses 62, 63*a* and 63*b*, so that the outer surfaces of the leads 18 are prevented from protruding beyond the outer side surfaces of the back plate 15.

The construction of the lighting circuit board 13A of this embodiment is substantially identical with that of the lighting circuit board 13 of the first embodiment. The lighting circuit board 13A, however, is made somewhat smaller than the lighting circuit board 13.

Figure 12:
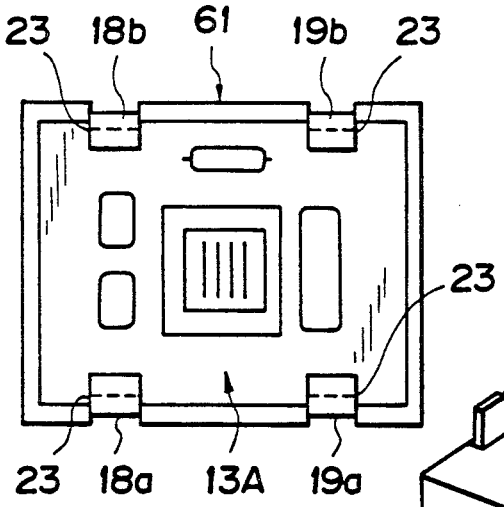

As shown in FIG. 12, this lighting circuit board 13A is concentrically placed on the upper surface of the back plate 15. In this condition, the protruding end sections of the leads 18*a* protruding beyond the upper surface of the lighting circuit board 13A are bent inwardly at substantially right angles, thereby bringing them into contact with the respective electric terminals 23 provided on the lighting circuit board 13A.

Thus, the lighting circuit board 13A is integrally attached to the lamp body 17 by means of the leads 18*a*. At the same time, it is electrical connected to the lamp body through the electric terminals 23.

The reference numerals 18, 19 in FIG. 9 indicate a pair of hollow-cathode-type cold cathodes.

Thus, in accordance with this embodiment, the leads 18*a* are fitted into the recesses 62, 63*a* and 63*b* without allowing them to protrude beyond the outer side surfaces of the lamp body 17, so that the fluorescent lamp device 61 involves no dead space and, consequently, can be made smaller.

As a result, the installation space required when incorporating the fluorescent lamp device into a liquid crystal display device or the like may be relatively small.

Figure 13:
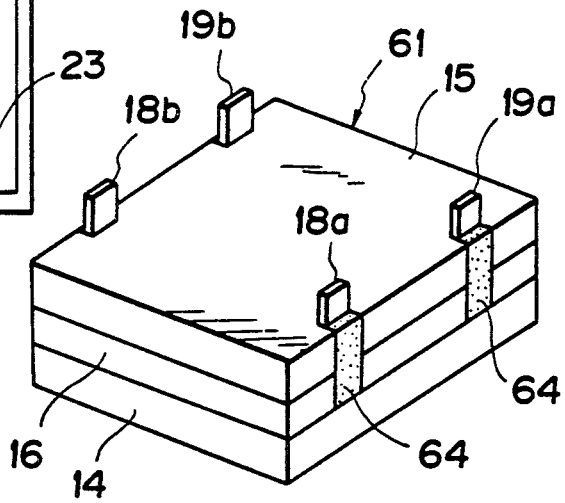

It is also possible, in this embodiment, to fill the recesses defined by the side surfaces of the recesses 62 and the outer surfaces of the leads 18*a* with frit glass 64, as shown in FIG. 13, when the leads 18*a* have been fitted into the recesses 62, 63*a* and 63*b* and bent to extend upwards, as shown in FIG. 10. In this way, the respective outer surfaces of the leads 18*a* can be insulated.

In that case, however, the outer surfaces of the frit glass 64 must be flush with the outer side surfaces of the back plate 15 and the spacer 16. They should not protrude beyond these outer side surfaces.

Figure 14:
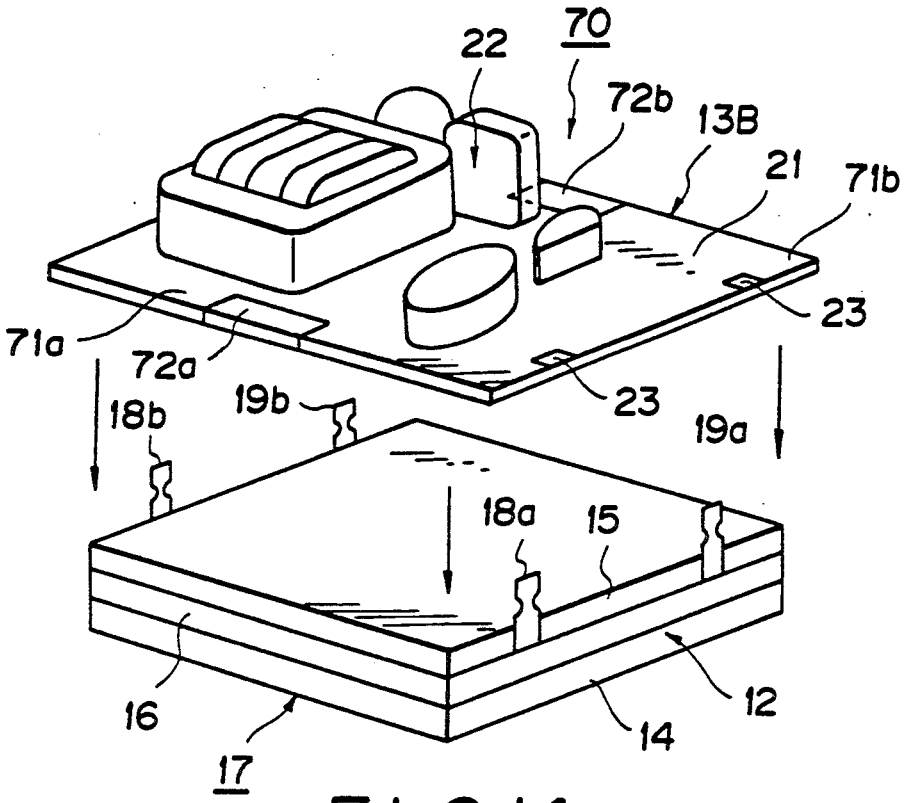
Figure 15:
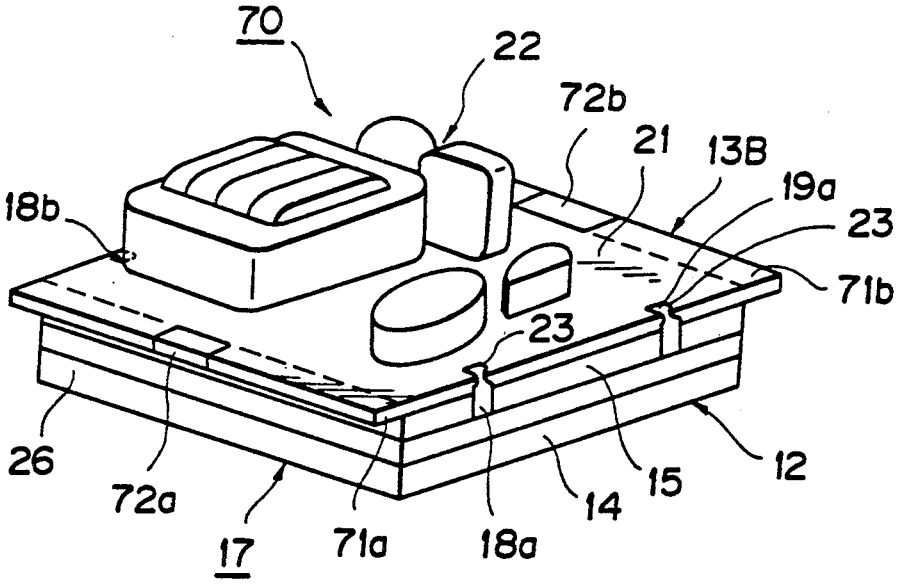
Figure 16A:
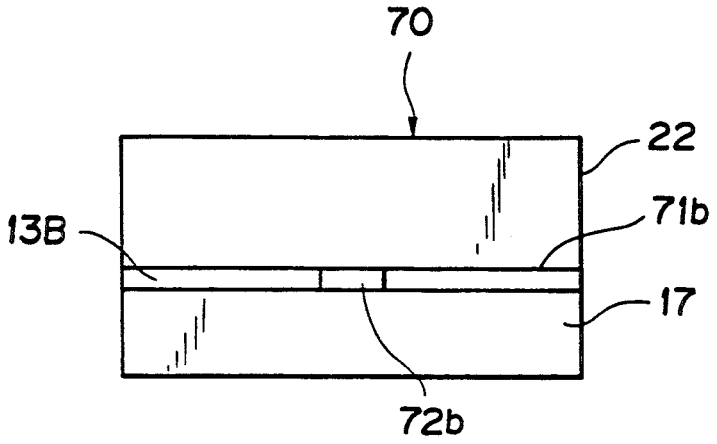
FIGS. 16A, 16B and 16C are, respectively, a schematic plan view, a front view and a right side view, of the this embodiment, corresponding to FIG. 15.
Figure 16B:
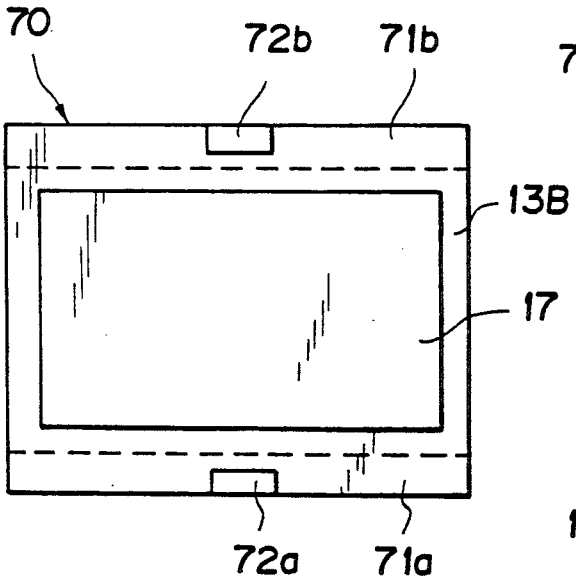
Figure 16C:
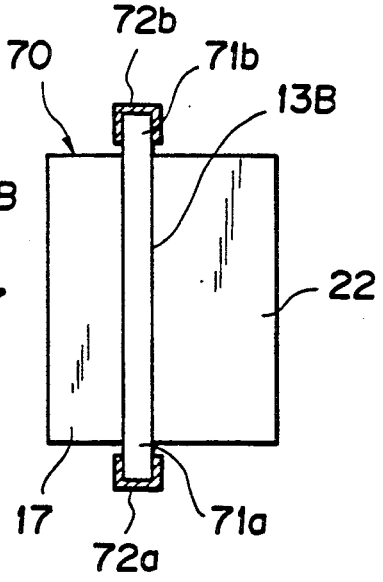

FIGS. 14 to 19 show the construction of a fluorescent lamp device 70 in accordance with a sixth embodiment of this invention. As shown in FIGS. 14 to 16, the lighting circuit board 13B of this fluorescent lamp device 70 has a construction which is substantially identical with that of the lighting circuit board 13 of the first embodiment. The lighting circuit board 13B of this embodiment is characterized in that the side sections of the board which are not equipped with electric terminals 23 extend horizontally outwards beyond the side edges of the back plate 15 by a predetermined length, these extending portions being formed integrally with the board.

The board 13B is provided with protruding end portions 71*a*, 71*b* respectively equipped with rectangular receiving terminals 72*a*, 72*b* of a predetermined size, which are attached to the board and extend from its upper to lower surface passing its side edge surfaces.

Figure 17:
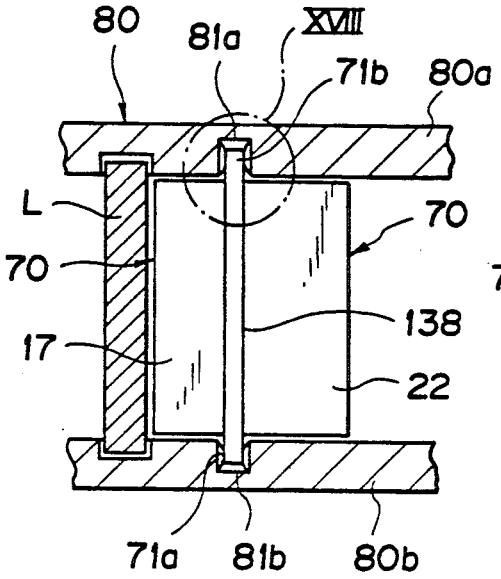

The above construction of this embodiment has been made with a view to facilitating the incorporation of the fluorescent lamp device 70, which consists of the lamp body 17 and the lighting circuit board 13B, integrally attached to each other, into the light-source lodging section 80 of a liquid crystal display device L or the like, as shown in FIG. 17. (Although in the example shown in FIG. 17 the liquid crystal display device is provided integrally with the light source lodging section 80, it is also possible to support it by means of a separately provided support means.)

The light source lodging section 80 are equipped with lodging grooves 81*a*, 81*b*, respectively. The pair of protruding end sections 71*a*, 71*b* of the fluorescent lamp device 70 are fitted into these lodging grooves and are allowed to slide therein.

Figure 18:
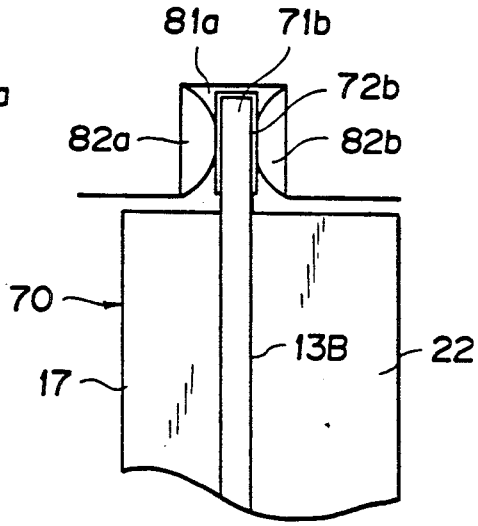
Figure 19:
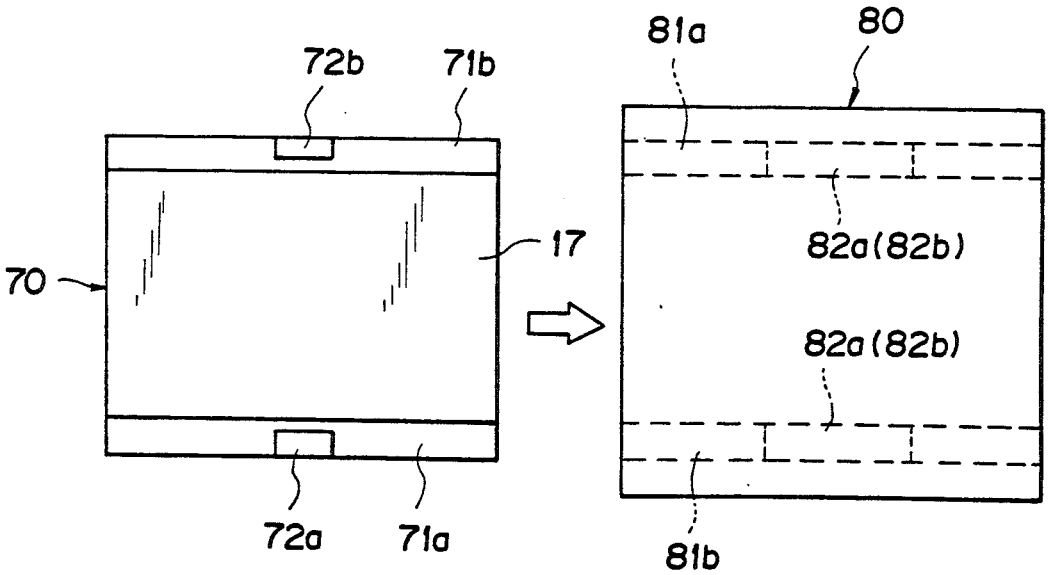

As shown in FIG. 18, the side walls of each of the lodging grooves 81*a*, 81*b* are equipped with semispherical feeding terminals 82*a*, 82*b*, respectively, which are convex into the groove. Each of the receiving terminals 72*a*, 72*b* of the lighting circuit board 13B is held between these feeding terminals 82*a*, 82*b* and is, at the same time, in electrical contact with these feeding terminals, so that electricity is fed through the feeding terminals 82*a*, 82*b* to the receiving terminals 72*a*, 72*b*.

Thus, when incorporating the fluorescent lamp device 70 of this embodiment into the light source lodging section 80, the protruding end sections 71*a*, 71*b* of the lighting circuit board 13B have only to be fitted into the pair of lodging grooves 81*a*, 81*b* and slid inwardly therein. The lighting circuit board 13B is then securely positioned, with the feeding terminals 82*a*, 82*b* being held in electrical contact with the receiving terminals 72*a*, 72*b*. In this way, the operation of lodging the lamp device in the light source lodging section 80 is substantially facilitated.

FIGS. 20 to 23 show an embodiment which is meant to enable the thickness of a fluorescent lamp like the one in the above embodiment, particularly, of a fluorescent lamp having an oblate cross section, to be reduced and, at the same time, improve the efficiency of the lamp.

Figure 20:
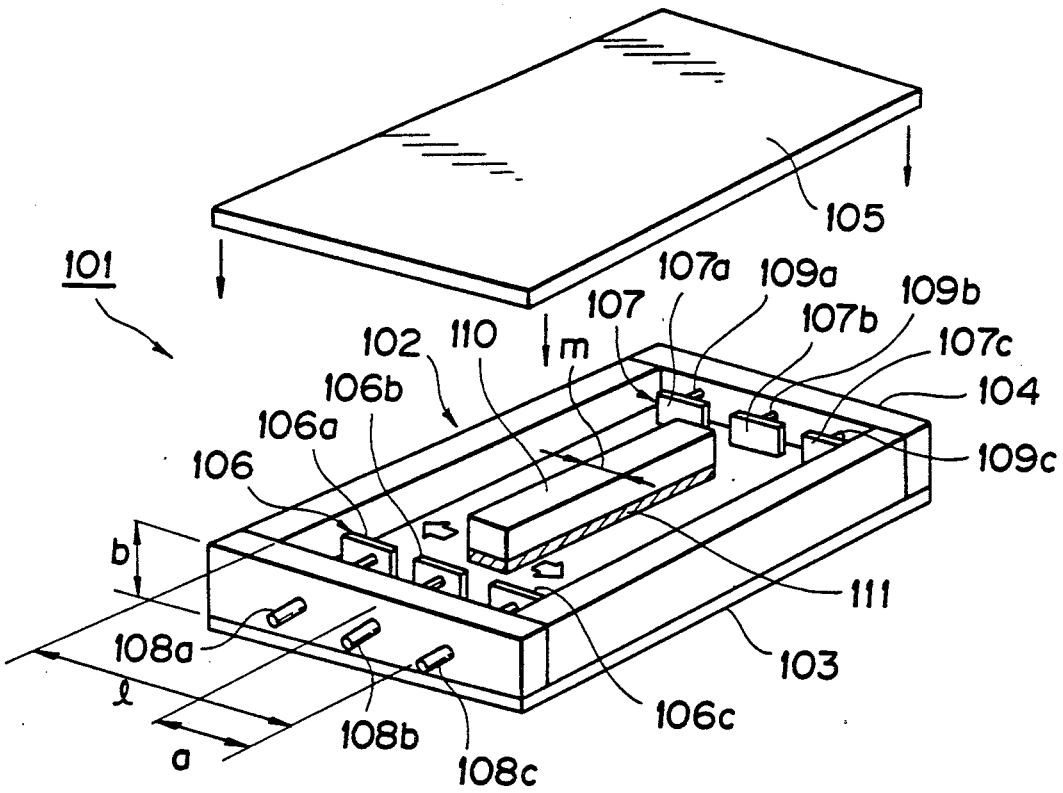
FIG. 20 is a partially exploded perspective view of an experimental fluorescent lamp.

The inventor of this invention conducted various experiments using the experimental oblate section type fluorescent lamp 101 shown in FIG. 20 with a view to finding out the conditions for enabling the thickness of an oblate section type fluorescent lamp to be reduced and, at the same time, improving the efficiency of the lamp.

The foregoing embodiments may be positively applied to a flat type fluorescent lamp device without any specific technology.

FIG. 20 is a schematic perspective view showing the construction of the experimental oblate section type fluorescent lamp 101. This experimental fluorescent lamp 101 is so designed that the flatness F of its bulb 102 can be varied.

The bulb 102 includes a back plate 103, which consists of a rectangular glass plate, and a spacer 104, which is in the form of a rectangular glass frame and which is placed concentrically on the back plate 103. This bulb 102 is sealed airtightly by means of an adhesive agent, such as frit glass. It should be noted that, although the spacers 104 and 123 (the latter of which is described below), shown in FIGS. 20 and 22, respectively, are arranged in a position identical with that of the spacer 16 in the above-described embodiments, this should not be construed as restrictive in terms of the structure of the entire fluorescent lamp.

The opening upper end of the spacer 104 is sealed by a front plate 105, which consists of a transparent glass plate. The entire inner surface of the front plate 105 is substantially coated with a fluorescent film, thus forming the front plate 105 as a luminous surface.

After removing the air inside the bulb 102, an appropriate amount of mercury and rare gas (argon gas, for example) are sealed in the bulb 102.

Provided inside the bulb 102 are a pair of electrodes 106, 107 in the form of quadrangular plates. These electrodes are respectively divided into three equal parts 106*a*, 106*b*, 106*c* and 107*a*, 107*b*, 107*c*, which are respectively connected to leads 108*a*, 108*b*, 108*c* and 109*a*, 109*b*, 109*c*. These leads 108*a* to 109*c* extend outwards through the end walls in the longitudinal direction of the spacer 104 and are electrically connected to the lighting circuit (not shown).

The flatness F of the bulb 102, thus constructed, is defined as the ratio of the inner dimension a of its length in the axial direction of the electrodes, i.e., the length in the longitudinal direction (hereinafter referred to as the longer diameter), to the inner dimension b of its length in the lateral direction (hereinafter referred to as the shorter diameter), i.e., as a/b.

In order to enable the dimension of the longer diameter a to be varied arbitrarily, a square glass bar 110 is placed on the inner surface of the back plate 103 and is arranged to extend parallel to the direction in which the pair of electrodes 106, 107 are opposed to each other, i.e., parallel to the discharge axis. A nickel plate 111 is attached to the bottom surface of the square glass bar 110, with the outer peripheral surfaces of the nickel plate 111 being coated with glass so as to electrically insulate them. The square glass plate 110, thus constructed, is placed on the back plate 103 in such a manner as to be able to slide thereon.

Supposing the inner dimension in the electrode-axis direction of the spacer 103 is and the dimension in the same direction of the square glass bar 110 is m, the above-mentioned longer diameter a can be defined as: $a=l-m$ in a case where the nickel plate 111 is disposed at a position contacting to the inner side of the bulb.

This is because of the fact that the upper limit in terms of practical use of the flat-type fluorescent lamp 101 is 0.30 mA/mm$^2$.

In the experiments performed, the coldest-portion temperature, which is the temperature of the exhaust pipe, not shown, which is filled with mercury and which extend into the atmosphere, was an ordinary temperature of about 25° C.

Next, the experiment results shown in FIG. 21 will be described.

In FIG. 21, the region A, surrounded by the solid line, represents the region where the discharge is stabilized. The hatched region B, situated above the region A and adjacent thereto, represents the region where the discharge is stabilized but where the efficiency of the lamp is lowered. The net-pattern region C, situated below the region A and adjacent thereto, represents the region where the luminance is low and where the lumen maintenance factor drops excessively.

Thus, in the region A, in which the discharge is stable, the cathode drop voltage is lowered as the pressure P of the argon gas is heightened, with the efficiency of the lamp becoming higher.

In the region B, the discharge is stable but the efficiency of the lamp is lowered, which means the region is not preferable as the operational range for the fluorescent lamp 101.

The reason for the low efficiency of the lamp in the region B is assumed to be as follows. Generally speaking, the efficiency of a lamp depends upon electrode dissipation and positive column dissipation; in the region B, the argon gas pressure is in excess of 200 torr, with the result that the dissipation due to the elastic collision in the positive column rather increases, causing the electron temperature to be lowered.

In the region C, the cathode drop voltage is raised as the argon gas pressure becomes lower. As a result, the electrode sputtering in this region occurs to a large degree, the lumen maintenance factor is lowered excessively, and the luminance is deteriorated to an excessive degree. Thus, this reion C is not preferable, either, as the operational range for the fluorescent lamp 101.

Accordingly, it is the region A that is preferable as the operational range for the fluorescent lamp 101. The range can be represented by the following inequalities (1) and (2):

$$\text{When } 1 \leqq F \leqq 3,\ 3 \leqq P \leqq 200 \quad (1)$$

$$\text{When } 3 \leqq F \leqq 8,\ 3 \leqq P \leqq e(-0.37F+6.4) \quad (2)$$

where F represents the flatness of the bulb 102 and P represents the pressure of the argon gas with which the bulb is filled.

Thus, by adjusting the flatness F of the bulb 102 and the argon gas pressure P in such a manner that they satisfy either inequality (1) or (2), the thickness of the fluorescent lamp can be reduced and, at the same time, the efficiency of the lamp can be improved.

Figure 22:
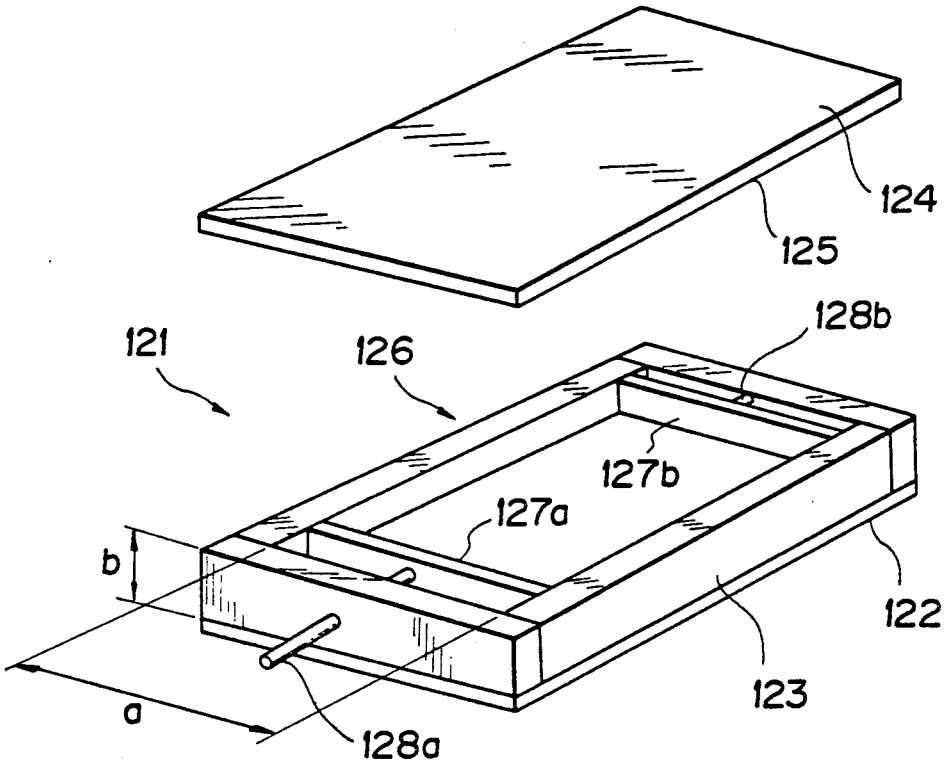
FIG. 22 ia a partially exploded perspective view of a fluorescent lamp to which an embodiment of this invention, illustrated with reference to FIG. 21, is applied.

The oblate section type fluorescent lamp of this embodiment is based on the above consideration and has a construction as shown in FIG. 22.

FIG. 22 is a partially exploded perspective view, which schematically shows the construction of an embodiment of this invention conceived in view of the above-described experiment. In the drawing, the oblate section type fluorescent lamp 121 shown includes a back plate 122, which consists of a rectangular glass plate, and a spacer 123, which is in the form of a rectangular glass frame and which is placed concentrically on the back plate 122. The back plate 122 and the spacer 123 are airtightly sealed by means of an adhesive agent such as frit glass.

Further, the upper opening of the spacer 123 is airtightly sealed by a front plate 124, which consists of a transparent glass plate with the same size and configuration as those of the back plate 122. An airtight sealing of frit glass is provided for the spacer 123 and the front plate 124. The entire inner surface of the front plate 124 is substantially coated with a fluorescent film 125, thus forming the front plate 124 as a luminous surface.

In this way, a box-shaped bulb 126 is formed. After removing the air inside the bulb 126, an appropriate amount of mercury and rare gas, i.e., argon gas, are sealed in the bulb 126.

The bulb 126 airtightly contains a pair of quadrangular electrodes **127*a*, 127*b*, which are opposed to each other in the longitudinal direction of the bulb 126 and which are attached to respective leads 128*a*, 128*b***.

One end section of each of the leads **128*a*, 128*b* extends outwards from inside the bulb through the spacer 123**, each extending end section being electrically connected to the lighting circuit, not shown.

Electricity is supplied from the lighting circuit, not shown to the section between the pair of electrodes **127*a*, 127*b* to such an extent that the discharge current density in the bulb 126 is 30 mA/mm$^2$ or less. Here, the term "discharge current density" means the ratio of the discharge current between the pair of electrodes 127*a*, 127*b* to the area of the flat section of the bulb 126**.

The flatness F, which is the ratio of the inner dimension a of the length in the electrode-axis direction, i.e., the length in the longitudinal direction of the flat longitudinal section of the bulb 126 (hereinafter referred to as the longer diameter) to the inner dimension b of the length in the lateral direction of the same section (hereinafter referred to as the shorter diameter), i.e., a/b, and the argon gas pressure P are set in such a manner that they satisfy either of the following inequalities (3) and (4).

$$\text{When } 1 \leqq F \leqq 3,\ 30 \leqq P \leqq 200 \quad (3)$$

$$\text{When } 3 \leqq F \leqq 8,\ 30 \leqq P \leqq e(-0.37F+6.4) \quad (4)$$

The region represented by these inequalities (3) and (4) is the region D of FIG. 21, which region is surrounded by the solid lines bordered by parallel oblique lines. This region D is included in the discharge stabilizing area A, which means the discharge between the pair of electrodes 127*a*, 127*b* is stable in this region.

In this region D, the cathode drop voltage is lowered by setting the argon gas pressure as high as possible, thereby enhancing the efficiency of the lamp. Thus, this region is preferable as the operational region for the oblate section type fluorescent lamp 121.

Figure 23:
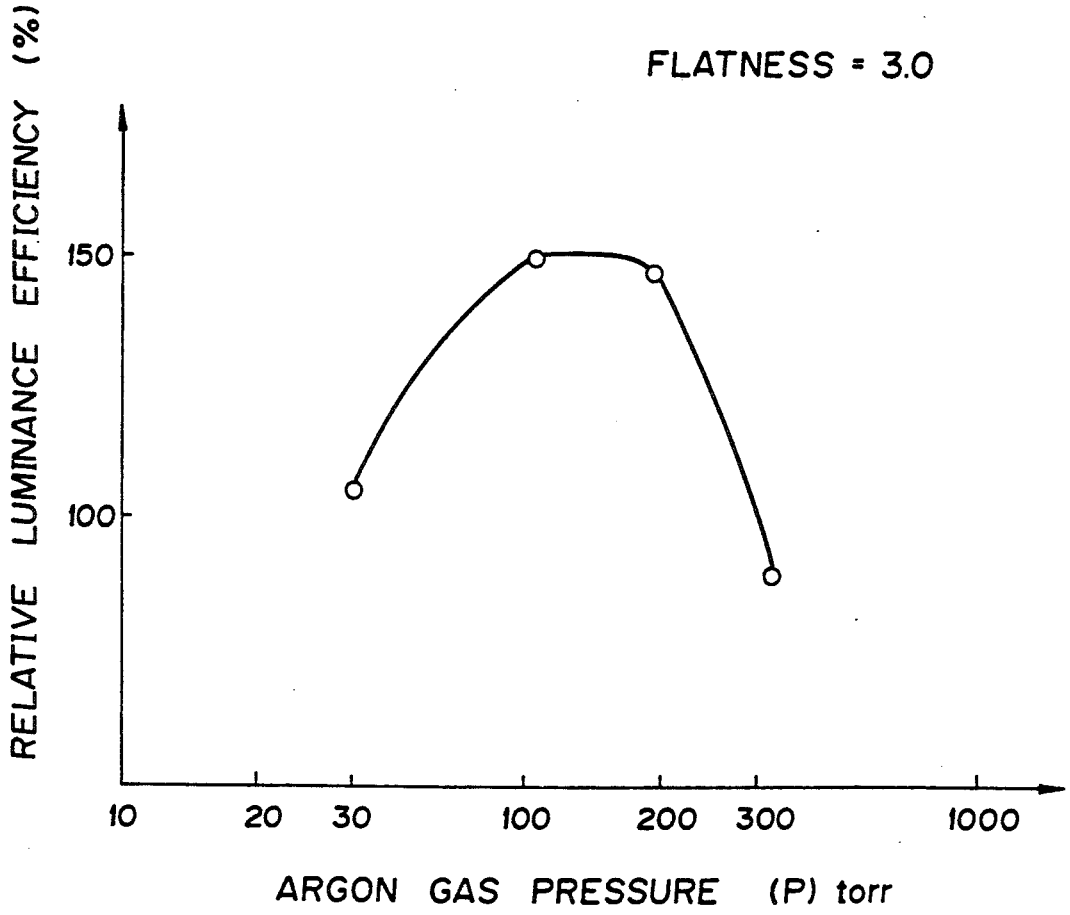
FIG. 23 is a graph showing the relative luminance efficiency in an oblate section type fluorescent lamp in accordance with an embodiment of this invention when the flatness is 3 and 8.

The relative luminance efficiency in the case where the flatness F is 3 and where inequality (3) is satisfied with respect to the case where the flatness F is 8 and where inequality (4) is satisfied, is represented by the curve shown in the graph of FIG. 23.

The graph of FIG. 23 shows the relative changes in luminance in the case where the flatness F is a value of 3 with respect to the case where the flatness F is a value of 8 and where the argon gas pressure P is 30 torr (In FIG. 23, the luminance efficiency in the latter case is assumed to be 100%). In this graph, the vertical axis represents the above-mentioned relative changes in luminance and the horizontal axis represents the changes in the argon gas pressure P.

It can be seen from FIG. 23 that an argon gas pressure P of 30 torr or more is preferable since the relative luminance efficiency is then over 100%.

However, an argon gas pressure P of more than 200 torr is not preferable for the operation of the fluorescent lamp 23 since such a pressure is in the range B of FIG. 21, where the lamp efficiency is low, although it involves no excessive deterioration in the relative luminance efficiency.

Accordingly, it is desirable that the fluorescent lamp 121 be such as to satisfy either inequality (3) or (4).

In this regard, the oblate section type fluorescent lamp 121 of this embodiment is so designed that the discharge current density is 30 $mA/mm^2$ or less and that the flatness F and the argon gas pressure P satisfy either inequality (3) or (4), so that the thickness of the bulb 126 can be reduced with the efficiency of the lamp being improved.

Although it is either inequality (3) or (4) that is to be satisfied in the above-described embodiment, this should not be construed as restrictive. It goes without saying that it may also be either inequality (1) or (2) since, as stated above, the range represented by inequalities (1) and (2) is in the range A of FIG. 21, where the discharge is stable.

Further, while in the above embodiment, the oblate section type fluorescent lamp 121 has a quadrangular section, it may also have an oval section.

While, in the above embodiment, the rare filling gas consists of 100% argon, around 10% or less of other rare gases may be mixed with it. Further, while the voltage applied to the pair of electrodes 127*a*, 127*b* in the above embodiment is a sine-wave voltage with a frequency of 40 KHz, the frequency and the waveform of this voltage are not limited to these.

It is to be understood that this invention is not limited to the described preferred embodiments and many other changes and modifications may be made according to this invention without departing from the scopes of the appended claims.

What is claimed is:

1. A fluorescent lamp device comprising:

an oblate section type fluorescent lamp having an oblate cross section;

a lighting circuit means mounted on said oblate section type fluorescent lamp; and an attaching means for attaching said lighting circuit means to said oblate section type fluorescent lamp;

said attaching means being led from said fluorescent lamp and consisting of a pair of bendable leads which are respectively electrically connected to a pair of electrodes, one end of each of said leads being engaged with electric terminal pieces of said lighting circuit means in such a manner as to be electrically connected to and engaged with said lighting circuit means, and wherein said oblate section type fluorescent lamp including a fluorescent lamp body comprises a front plate, a back plate and a spacer which is provided between said front plate and said back plate and which defines a bulb of said oblate section type fluorescent lamp, said lighting circuit means being composed of a board which is to be placed on the back plate to said fluorescent lamp body and a lighting circuit which is attached to said board.

2. A fluorescent lamp device according to claim 1, wherein said bendable leads have portions extending outwards from a pair of opposing sides of the back plate, each of said bendable leads has a substantially rectangular structure and wherein said electric terminal pieces of said lighting circuit means each having a box shape are attached to the upper surface of said lighting circuit means at portions corresponding to the extending portions of said bendable leads so as to have spaces in the box shaped structures in the attached state, a front end of each of extending portions of said bendable leads being inserted into the space of said electric terminal pieces of said lighting circuit means by bending the extending portion.

3. A fluorescent lamp device according to claim 1, wherein said bendable leads have portions extending outwards from a pair of opposing sides of the back plate, said back plate is provided with another pair of sides and said lighting circuit means is provided with a pair of sides corresponding to said another pair of sides of said back plate, said pair of sides of the lighting circuit means having portions extending over said another pair of sides of the back plate, receiving terminal pieces being formed to said extending portions of said lighting circuit board.

4. A fluorescent lamp device according to claim 1, wherein said bendable leads have portions extending outwards from a pair of opposing sides of the back plate, each of said bendable leads has a substantially T-shaped structure provided with a front end having a width wider than other portion thereof and an inwardly cutout portion and wherein said electric terminal pieces of said lighting circuit means are embedded therein with upper surfaces being exposed outward at portions corresponding to the extending portions of said bendable leads, each of said terminal pieces having a width corresponding to the width of the T-shaped bendable lead, a front of each of extending portions of said bendable leads being contacted to said electric terminal pieces of said lighting circuit means by bending the extending portion at the cutout.

5. A fluorescent lamp device according to claim 4, wherein said opposed sides of the back plate being provided with recessed portions corresponding to outer configuration of the extending portions of said bendable leads, said extending portions being fitted into said recessed portions of the back plate when said extending portions are bent and wherein said spacer has two pairs of sides, one of said pairs corresponding to said opposed sides of the back plate are provided with recessed portions into which said bendable leads are fitted.

6. A fluorescent lamp device according to claim 5, wherein the recessed portions of said back plate and said spacer are filled up with a frit glass after fitting the bendable leads.

7. A fluorescent lamp device according to claim 1, wherein said bendable leads have portions extending outwards from a pair of opposing sides of the back plate, each of said bendable leads is composed of a flexible metallic plate member of substantially rectangular structure and wherein said electric terminal pieces of said lighting circuit means are embedded therein with upper surfaces being exposed outward at portions corresponding to the extending portions of said bendable leads, a front end of each of extending portions of said flexible metallic leads being contacted to said electric terminal piece of said lighting circuit board by bending the extending portion, the bending portion being above the upper surface of said terminal piece.

8. A fluorescent lamp device according to claim 7, wherein said opposed sides of the back plate being provided with recessed portions corresponding to outer configuration of the extending portions of said bendable leads, said extending portions being fitted into said recessed portions of the back plate when said extending portions are bent and wherein said spacer has two pairs of sides, one of said pairs corresponding to said opposed sides of the back plate are provided with recessed portions into which said bendable leads are fitted.

9. A fluorescent lamp device according to claim 8, wherein the recessed portions of said back plate and said spacer are filled up with a frit glass after fitting the bendable leads.

10. A fluorescent lamp device comprising:

an oblate section type fluorescent lamp having an oblate cross section;

a lighting circuit means mounted on said oblate section type fluorescent lamp; and an attaching means for attaching said lighting circuit means to said oblate section type fluorescent lamp;

said attaching means being led from said fluorescent lamp and consisting of a pair of bendable leads which are respectively electrically connected to a pair of electrodes, one end of each of said leads being engaged with electric terminal pieces of said lighting circuit means in such a manner as to be electrically connected to and engaged with said lighting circuit means, and wherein said bendable leads have portions extending outwards from a pair of opposing sides of the back plate, each of said bendable leads has a substantially rectangular structure provided with an inwardly cutout portion and wherein said electric terminal pieces of said lighting circuit means are embedded therein with upper surfaces being exposed outwards at portions corresponding to the extending portions of said bendable leads, a front end of each of extending portions of said bendable leads being contacted to said electric terminal pieces of said lighting circuit means by bending the extending portion at the cutout.

11. A fluorescent lamp device according to claim 10, wherein said opposed sides of the back plate being provided with recessed portions corresponding to outer configuration of the extending portions of said bendable leads, said extending portions being fitted into said recessed portions of the back plate when said extending portions are bent and wherein a spacer has two pairs of sides, one of said pairs corresponding to said opposed sides of the back plate are provided with recessed portions into which said bendable leads are fitted.

12. A fluorescent lamp device according to claim 11, wherein the recessed portions of said back plate and said spacer are filled up with a frit glass after fitting the bendable leads.

* * * * *